US005389237A

United States Patent [19]

Harandi et al.

[11] Patent Number: 5,389,237

[45] Date of Patent: Feb. 14, 1995

[54] FCC PROCESS WITH LIFT GAS

[75] Inventors: Mohsen N. Harandi, Langhorne; Paul H. Schipper, Doylestown, both of Pa.

[73] Assignee: Mobil Oil Corporation, Fairfax, Va.

[21] Appl. No.: 28,018

[22] Filed: Mar. 8, 1993

[51] Int. Cl.[6] ..... C10G 11/18

[52] U.S. Cl. ..... 208/153; 208/161; 208/164; 208/113

[58] Field of Search ..... 208/149, 150, 111, 153, 208/161, 164

[56] References Cited

U.S. PATENT DOCUMENTS 3,406,112 10/1968 Bowles ..... 208/153
4,479,870 10/1984 Hammershaimb et al. ..... 208/164
4,988,430 1/1991 Sechrist et al. ..... 208/150
5,007,999 4/1991 Chen ..... 208/149
5,268,090 12/1993 Lomas et al. ..... 208/153

*Primary Examiner*—Helane Myers
*Attorney, Agent, or Firm*—Alexander J. McKillop; Malcolm D. Keen; Richard D. Stone

[57] ABSTRACT

A process for fluidized catalytic cracking of heavy feed using a low $H_2S$ content lift gas in the base of a riser reactor. The lift gas is a recycled, ethylene rich stream obtained by removing $H_2S$ from a compressed vapor stream intermediate the FCC main column receiver and the gas plant associated with the FCC unit. The low $H_2S$ lift gas does not increase $SO_x$ emissions from the regenerator as much as a recycled vapor from the FCC main column. As the lift gas is not purified in the gas plant it does not overload it.

10 Claims, 2 Drawing Sheets

FCC PROCESS WITH LIFT GAS

BACKGROUND OF THE INVENTION

This invention relates to fluid catalytic cracking (FCC).

BACKGROUND OF THE INVENTION

Many refineries devote extraordinary amounts of energy and operating expense to convert most of a whole crude oil feed into high octane gasoline. The crude is fractionated to produce a virgin naphtha fraction which is usually reformed, and a gas oil and/or vacuum gas oil fraction which is catalytically cracked to produce naphtha, and light olefins. The naphtha is added to the refiners gasoline blending pool, while the light olefins are converted, usually by HF or sulfuric acid alkylation, into gasoline boiling range material which is then added to the gasoline blending pool.

The FCC process is the preferred process in the petroleum refining industry for converting higher boiling petroleum fractions into lower boiling products, especially gasoline. In FCC, a finely divided solid cracking catalyst promotes cracking reactions. The catalyst is in a finely divided form, typically with a particles of 20–100 microns, with an average of about 60–75 microns. The catalyst acts like a fluid (hence the designation FCC) and circulates in a closed cycle between a cracking zone and a separate regeneration zone.

In FCC, fresh feed contacts hot catalyst from the regenerator in the base of a riser reactor. Usually there is a "Y" shaped connection in the base of the riser, with regenerated catalyst charged into one arm of the "Y" and the resulting catalyst mixture passing vertically up, which can be considered the other arm of the "Y". There are many localized catalyst currents and eddies, and many refiners now start the catalyst flowing smoothly up the riser by injecting some sort of lift gas. There is better catalyst/oil contacting when a lift gas is used, and some refiners believe that the lift gas can "condition" the FCC catalyst, so that it works better in the cracking reactor.

The cracked products are discharged from the riser cracking reactor to pass through a main fractionator which produces several liquid streams and a vapor stream containing large amounts of $H_2S$ and light olefins. The vapor stream is compressed in a wet gas compressor and charged to the unsaturated gas plant, for sulfur removal and product purification.

A further description of the catalytic cracking process may be found in the monograph, "Fluid Catalytic Cracking With Zeolite Catalysts," Venuto and Habib, Marcel Dekker, New York, 1978, incorporated by reference.

While FCC is an efficient converter of heavy feed to lighter products, many problems remain. One attractive way to improve the process, use of a lift gas, solves some problems in the riser, but creates problems in the regenerator and in product recovery facilities. $SO_x$ emissions from the regenerator can increase, and/or overloading of the FCC Unsaturated Gas Plant (USGP) can occur. Each area will be briefly reviewed.

$SO_x$ EMISSIONS FROM FCC GAS RECYCLE

Local environmental restrictions limit the amount of $SO_x$ which can be discharged into the atmosphere with the FCC regenerator flue gas. While $SO_x$ additives can be added to the circulating catalyst inventory, many refiners are concerned about $SO_x$ emissions. This is especially so where a refiner makes use of a light hydrocarbon lift gas, either for flow smoothing and/or conditioning of catalyst in the base of the riser. If some of the sulfur laden vapor removed from the FCC main column overhead were merely recycled, it would add sulfur to the spent catalyst stream flowing to the regenerator. $SO_x$ emissions from the regenerator flue gas would increase, since this gas may contain as much as 5 to 10 mole % $H_2S$ $H_2S$ sent to the riser bottom can also react, particularly with olefins and CO (which may be present in the regenerated catalyst stream) to make additional sulfur containing hydrocarbons and COS. These sulfur compounds will have to be treated in the recovery section.

UNSATURATED GAS PLANT

The FCC unsaturated gas plant (USGP) is expensive and extensive. Large volumes of normally gaseous materials, primarily from the FCC, but frequently from other units such as the coker, are passed through a wet gas compressor, a stripper/absorber to recover gasoline components, an amine absorber to remove $H_2S$ and some other components, and other fractionators and treaters. The units take up a lot of space in the refinery, and are expensive, especially the wet gas compressor. Because of the corrosive nature of the streams charged to the USGP, maintenance expenses can be high, as well as construction costs. It can be difficult to expand the capacity of such units because of site constraints, and the construction costs associated with corrosion resistant equipment.

When an FCC operator uses a clean fuel gas stream produced in the USGP as a lift gas in the base of the FCC riser reactor, most of this fuel gas returns to the USGP, increasing the load on the wet gas compressor and the absorbers, etc in the USGP. In some refineries, the USGP is the limiting factor on feed throughput in the FCC unit, so any use of clean fuel gas from the USGP as a lift gas can limit FCC feed rate.

Some of the bottleneck can be avoided by use of a sulfur containing gas stream which does not come from the USGP nor return to it. Thus some of the gas discharged from the wet gas compressor may be recycled to the FCC riser base for use as a lift gas, but this will increase $SO_x$ emissions from the FCC regenerator.

We wanted to have the benefits of FCC lift gas without increasing $SO_x$ emissions or overloading the FCC USGP.

We discovered a gas stream, and a simply treatment step of this gas stream, which could be used to produce a lift gas for the FCC riser, without increasing the amount of material that needed to be processed in the USGP. We were even able, in a preferred embodiment, to reduce the corrosiveness of the entire gas stream which must be processed in the USGP.

BRIEF SUMMARY OF THE INVENTION

Accordingly, the present invention provides a process for the fluidized catalytic cracking of a feed containing sulfur and hydrocarbons boiling above 650 F. to catalytically cracked products comprising: charging to a base portion of a riser reactor a stream of regenerated catalyst and an ethylene products and accelerating said catalyst up said riser reactor; contacting said accelerated catalyst with said feed hydrocarbons in a lower portion of said riser reactor to produce a mixture of regenerated catalyst and feed; cracking said mixture in said riser reactor to produce a mixture of cracked products including ethylene and $H_2S$ and spent catalyst which are discharged from a top portion of said riser reactor; separating said mixture to produce a stream of catalytically cracked products which are removed as a product for transmission to an FCC main fractionator and a stream of spent catalyst containing entrained and absorbed catalytically cracked products and coke; stripping said spent catalyst in a stripping means by contact with a stripping gas at stripping conditions to produce stripped catalyst; regenerating said stripped catalyst in a catalyst regeneration means at catalyst regeneration conditions including contact with an oxygen containing gas to produce regenerated catalyst; recycling said regenerated catalyst to said cracking reactor to contact said feed; fractionating said cracked products in said FCC main fractionator to produce a plurality of liquid product streams and an overhead vapor stream containing ethylene and $H_2S$; compressing said overhead vapor stream to produce a compressed vapor stream containing ethylene and $H_2S$; splitting said compressed vapor stream into a lift gas fraction and a product fraction; removing $H_2S$ from said lift gas fraction of said compressed vapor stream in an $H_2S$ removal means to produce a compressed vapor containing ethylene and a reduced $H_2S$ content; recycling to said base of said riser reactor said lift gas fraction; and charging to a gas plant said product fraction of said compressed vapor.

In a more limited embodiment, the present invention provides a process for the fluidized catalytic cracking of a feed containing sulfur and hydrocarbons boiling above 650 F. to catalytically cracked products comprising charging to a base portion of a riser reactor a stream of regenerated catalyst and an ethylene containing lift gas recovered from said catalytically cracked products and accelerating said catalyst up said riser reactor; contacting said accelerated catalyst with said feed hydrocarbons in a lower portion of said riser reactor to produce a mixture of regenerated catalyst and feed; cracking said mixture in said riser reactor to produce a mixture of cracked products including ethylene and $H_2S$ and spent catalyst which are discharged from a top portion of said riser reactor at a pressure of 1 to 75 psig; separating said mixture to produce a stream of catalytically cracked products which are removed as a product for transmission to an FCC main fractionator and a stream of spent catalyst containing entrained and absorbed catalytically cracked products and coke; stripping said spent catalyst in a stripping means by contact with a stripping gas at stripping conditions to produce stripped catalyst; regenerating said stripped catalyst in a catalyst regeneration means at catalyst regeneration conditions including contact with an oxygen containing gas to produce regenerated catalyst; recycling said regenerated catalyst to said cracking reactor to contact said feed; fractionating said cracked products in said FCC main fractionator at a pressure of 0 to 60 psig to produce a plurality of liquid product streams and an overhead vapor stream containing ethylene and $H_2S$, said overhead vapor stream having a pressure of 0 to 60 psig; compressing said overhead vapor stream at least 25 psi in a primary compressor to produce a primarily compressed vapor stream containing ethylene and $H_2S$ having a pressure above said FCC main fractionator; removing $H_2S$ from said primarily compressed vapor in an amine absorber to produce a primarily compressed vapor containing ethylene and a reduced $H_2S$ content; compressing said primarily compressed vapor in a secondary compressor to produce a high pressure vapor having a pressure of at least 150 psig and sufficient to charge to an unsaturated gas plant; recycling to said base of said riser reactor a lift gas fraction obtained from said high pressure vapor stream; and charging to said gas plant high pressure vapor.

DESCRIPTION OF PREFERRED EMBODIMENTS

Figure 1:
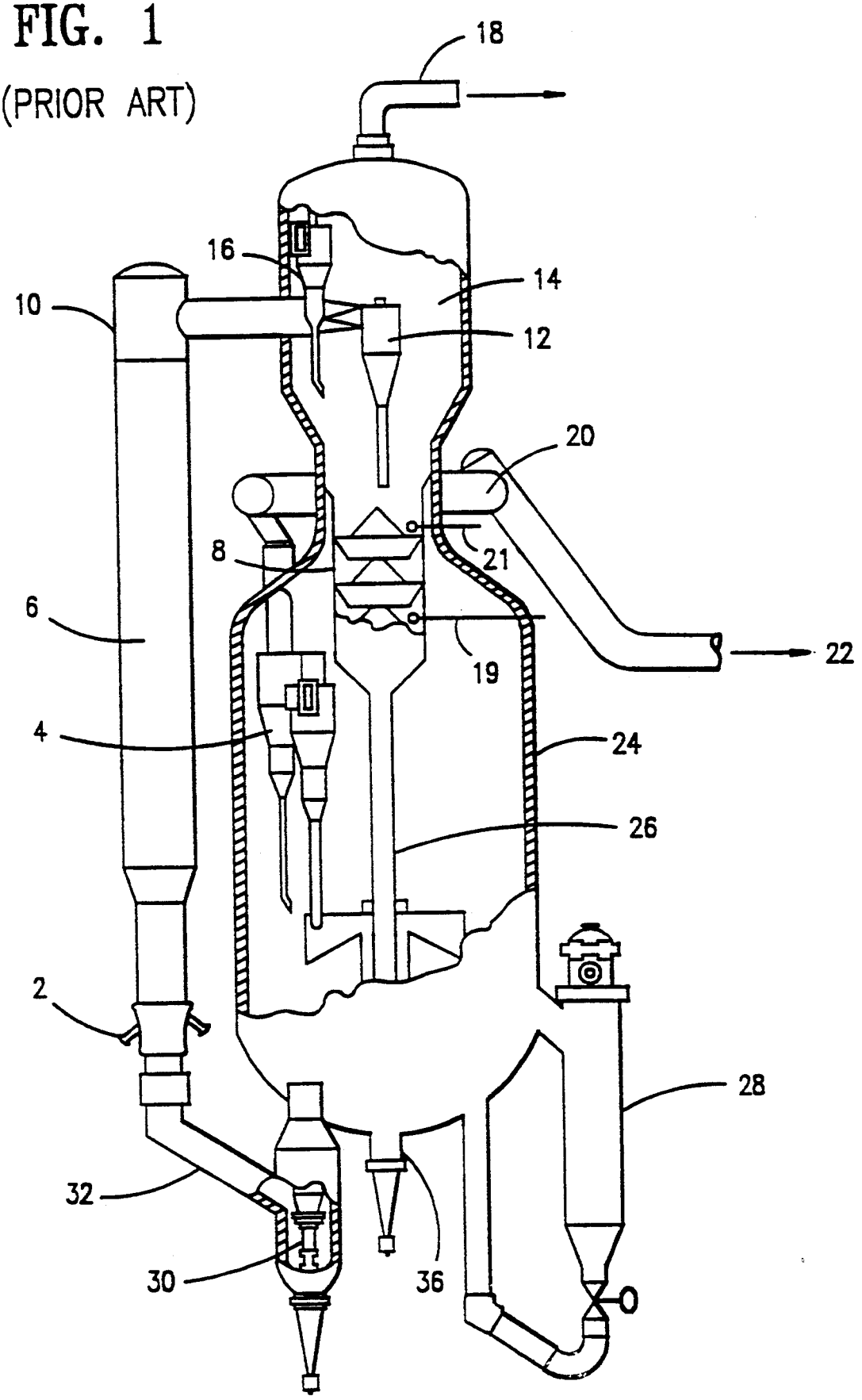
FIG. 1 (PRIOR ART)
FIG. 1 (Prior Art) shows a conventional FCC unit with a riser reactor and lift gas addition in the base of the riser.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The catalyst is pre-accelerated up the riser upstream of the feed by injection of lift gas to the base of the riser via lines 49 and 51. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted by lines 19 and 21. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

Catalyst is regenerated in regenerator 24 by contact with air, added via air lines and an air grid distributor not shown. A catalyst cooler 28 is provided so that heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is in the upper portion of regenerator 24. Entrained catalyst is separated from flue gas in multiple stages of cyclones 4, and discharged via outlets 8 into plenum 20 for discharge to the flare via line 22.

Although not shown, the riser lift gas added via lines 49 from a fuel gas stream produced in the unsaturated gas plant.

Figure 2:
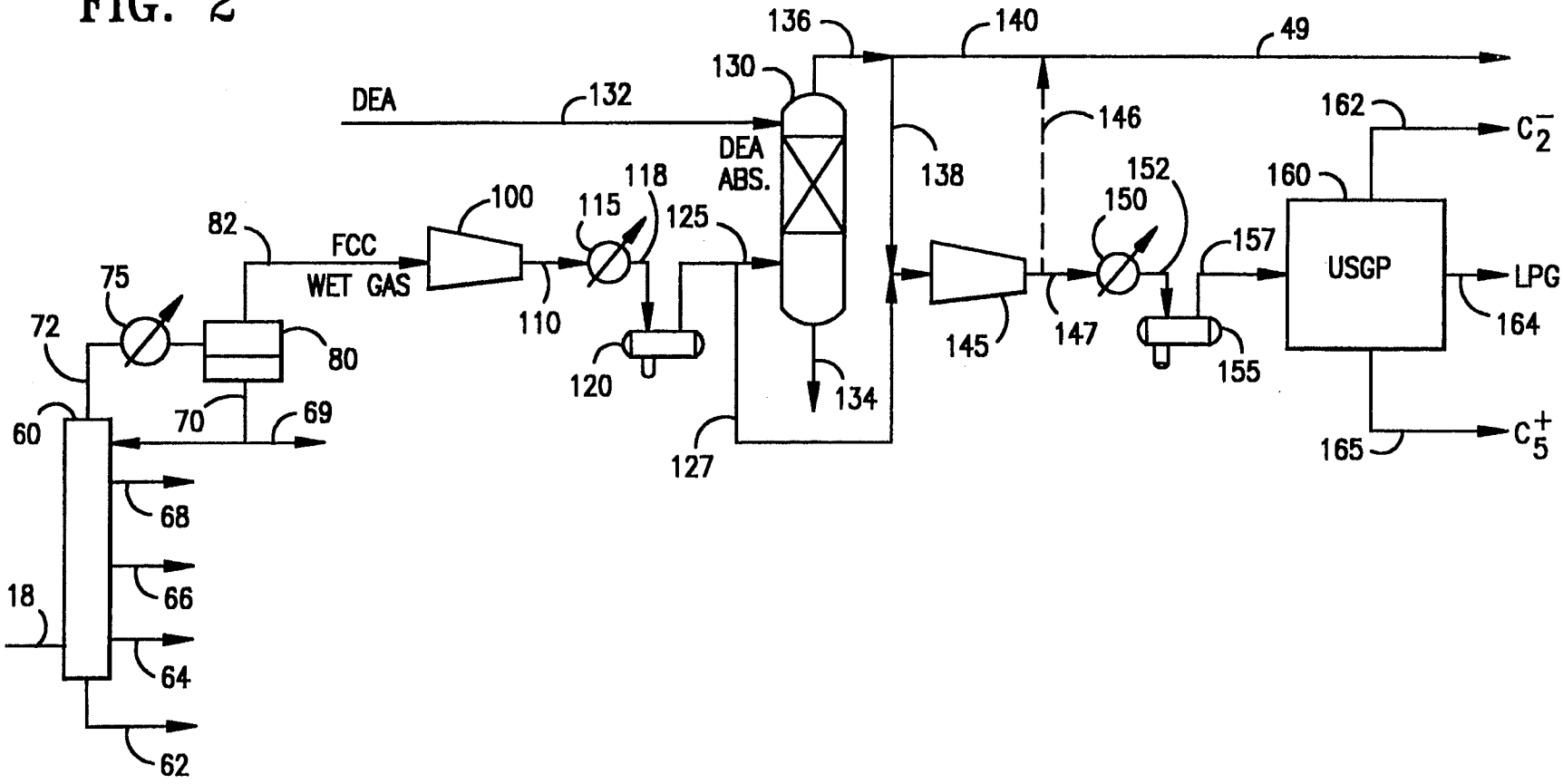
FIG. 2 (Invention) shows a simplified block diagram of a preferred embodiment, with an amine scrubber intermediate the wet gas compressor and the USGP.

FIG. 2 (Invention) shows the integration of a conventional FCC main fractionator 60 and unsaturated gas plant (USGP 160 with a multi-stage compression system and amine treater of the invention in between.

Hot cracked vapors removed from the FCC reactor via line 18 enter the base of the main column 60. The column produces a spectrum of normally liquid products ranging from a heavy slurry oil product in line 62, to heavy cycle oil in line 64, light cycle oil in line 66, a naphtha fraction in line 68, and a normally gaseous fraction in line 82. This gas is derived from the overhead vapor removed via line 72, cooled in cooling means 75 to produce a vapor liquid mixture which is separated in V/L separator 80 to produce reflux returned to the column by line 70, a liquid product fraction removed via line 69, and an FCC main column overhead receiver vapor fraction removed via line 82.

The vapor fraction in line 82 is compressed in wet gas compressor 100 to increase its pressure to 60 to 110 psig, preferably from 65 to 105 psig, and the compressed vapors charged to cooling means 115. The cooled vapor is discharged via line 118 into separator 120. The liquid fraction may be charged by means not shown to the USGP 160. The vapor removed from separator 120 is charged via line 125 to DEA absorber 130. A regenerated or lean amine stream is added via line 132 to the top of the column, while the vapor stream 125 is added to a lower portion of the absorber. The absorber contains conventional trays or column packing, usually less than an amount equal to 20 theoretical trays, typically 10 to 20 theoretical trays. The $H_2S$ rich amine solution is removed via line 134 and charged to an amine solution regeneration means not shown. A vapor stream with a greatly reduced $H_2S$ content is removed via line 136 and may be sent directly to the base of the FCC riser reactor via lines 140 and 49.

Some gas may bypass the absorber 130, and pass directly from V/L separator 120 via line 127 to the suction side of compressor 145. This will reduce the size and cost of the amine absorber 130, and mean that only that portion of the FCC wet gas which is destined for use as a lift gas will be subjected to $H_2S$ removal upstream of the gas plant. This will not significantly reduce the amount of acid gas, particularly $H_2S$ which will be treated in the USGP, but will minimize the amount of work (compressor HP) required to generate the lift gas, and minimize the size and operating cost of the absorber 130.

Usually it will be preferred to pass most or all of the gas from V/L separator 120 through the amine absorber, and then split gas flow into a lift gas portion in line 140, and a USGP portion in line 138. The USGP portion is compressed in compressor 145, discharged via line 147 to cooling means 150 (which may be a water cooled heat exchanger, a fin fan cooler or the like) and charged via line 152 to V/L separator 155. The vapor product will be charged via line 157 to USGP 160, which is conventional. The USGP will usually produce a C2 and lighter stream removed via line 162, an LPG (C3/C4) stream removed via line 164 and a C5+ stream removed via line 165.

In some FCC units it may be beneficial to pass the entire vapor from the primary compressor 100 through the amine scrubber, and then compress the entire effluent from the amine scrubber in second stage compressor 145, and then split the compressed stream into a lift gas fraction and an USGP fraction. Another variation is to compress the gas as in the prior art, pass at least the noncondensible portion of the compressed gas through an amine scrubber, and then split the resulting $H_2S$ deficient, high pressure vapor into a lift gas stream and an USGP stream. This approach will permit $H_2S$ removal at a higher pressure, higher pressers make it easier to achieve $H_2S$ removal.

CRACKING CATALYST

Conventional cracking catalyst may be used. It is preferred to use a highly active cracking catalyst. The catalyst zeolite content, as measured by the large pore, or Y zeolite content, of the makeup catalyst, should be at least 15 wt %, and more preferably at least 25 wt % or higher.

CRACKING REACTOR

A conventional riser cracking reactor can be used provided it has some means for injecting lift gas into one or more locations as the base of the riser. Lift gas injection per se is conventional, and forms no part of the present invention.

REACTOR CONDITIONS

The process uses conventional riser cracking conditions. These include a riser top temperature of 950 to 1200 F., preferably 975 to 1050 F., a pressure of atmospheric to 50 psig, and a cat:oil weight ratio of from about 1:1 to 20:1, preferably from 3:1 to 6:1. The feed is usually preheated to 500 to 700 F., though some may operate with higher or lower feed preheat than this.

CATALYST STRIPPING/REGENERATION

Catalyst stripping and regeneration may be conventional. Catalyst is usually stripped with steam, and the resulting stripped catalyst regenerated by contact with an oxygen containing gas in the regenerator.

WET GAS COMPRESSOR

The existing wet gas compressor may be used in many instances. When this is done, all or a portion of the vapor stream discharged from the wet gas compressor will be charged to the sulfur removal means, discussed below.

Preferably, and especially for new installations, two or more stages of wet gas compression are used, with at least some cooling and condensation of compressed vapor to minimize compression costs and prevent recycle of C3/C4 and gasoline boiling range hydrocarbons.

Two or more stages of compression, as shown in FIG. 2, allow the gas being recycled to the FCC, and the $H_2S$ removal means associated with this stream, to operate at lowest pressure needed to get through this equipment and back to the FCC riser.

Cooling, and V/L separation will allow much of the C3/C4 hydrocarbons to be condensed and removed, and essentially all of the normally gasoline boiling range hydrocarbons. Many refiners are concerned about the reactivity of the C4–C5 olefins, especially in the extremely high temperature region where lift gas is used, and wish to avoid sending this material to the riser reactor. The gasoline fraction is valuable for use in the refinery gasoline pool, and normally should not be recycled for use as lift gas.

SULFUR REMOVAL MEANS

It is essential to have a sulfur removal means for treating the gas stream to be recycled to the base of the riser reactor. In most refineries this will be a conventional amine scrubber, such as one shown schematically in FIG. 2. In such a unit, an amine solution such as diethanolamine (DEA) is added to the top of an absorber, while an $H_2S$ containing stream is added to the base. Convention gas/liquid contact means, such as trays or packing may be present to improve contact of DEA solution and vapor. The DEA solution is added lean, that is, with a low $H_2S$ content, and leaves the absorber rich in absorbed $H_2S$.

The amine absorber can be designed to do a poor job of $H_2S$ removal, but on the entire wet gas vapor stream. Removing only 80 to 90% or so of the entering $H_2S$ makes the lift gas stream clean enough so any increase in $SO_x$ emissions from the regenerator will be negligible, or on the order of a 1 or 2% which can easily be dealt with by adding a modest amount of a $DeSO_x$ additive. This limited removal simplifies the design of the absorber, allows using a typical rich amine solution instead of a lean amine solution and/or increases the $H_2S$ loading of the amine solution which may be tolerated. Preferably, the absorber removes 70 to 100 of the $H_2S$, more preferably 85 to 98% of the $H_2S$. This amount of $H_2S$ removal need not produce satisfactory products from the gas plant for sale, but will reduce the corrosiveness of this gas stream, and reduce the amount of work that must be done in the USGP.

UNSATURATED GAS PLANT (USGP)

Conventional technology may be used. Although there are many variations in unit design, a basic design is shown and discussed in Meyers Handbook of Petroleum Refining Processes, McGraw Hill 1986, in Gas-Concentration Section 2-21 to 2-22 and FIG. 2.2-6. An overhead gas from the FCC main column overhead receiver is compressed, and the compressed gas mixed with stripper vapor overhead and primary absorber bottoms, then cooled and separated in a high pressure separator (HPS) to produce a vapor phase and a liquid phase product.

The HPS vapor phase is charged to a primary absorber, then to a secondary or sponge absorber. The vapor product remaining after passing through the primary and secondary absorber is usually sent to an amine treater for removal of $H_2S$.

The HPS liquid is charged to a stripper to produce a vapor phase which is recycled to mix with compressed gas and a liquid phase which is charged to a debutanizer.

There are many variations in individual units, but FCC gas plants will almost always have at least the following elements:

a compressor for vapor from the FCC main column overhead receiver;

at least one absorber, to recover gasoline boiling range components present in the compressed vapor and produce a gasoline free (and usually a reduced C3/C4 content) vapor; and at least one $H_2S$ removal means, usually an amine scrubber, to remove $H_2S$ from the vapor phase product from the absorber.

The USGP usually operates at 100 to 500 psig, preferably at about 150 to 325 psig. Higher pressures make it easier to condense many of the light streams involved.

Most gas plants use amine scrubbers or treaters. In these an amine rich solution such as mono-ethanol-amine (MEA) or diethanol-amine (DEA) or a mixture circulates to absorb or react with $H_2S$ in hydrocarbon vapor. The amine absorbs $H_2S$ and other acidic gasses which might be present and becomes "spent". The amine solution is typically regenerated by heating to release or drive off the absorbed $H_2S$. The desorbed $H_2S$ is typically sent to a Claus unit for sulfur recovery.

Although almost all refiners use amine scrubbers, because of their reliability and relatively low cost, there are other types of $H_2S$ removal which could be used though not necessarily with equivalent results. Thus caustic treatment with NaOH will remove $H_2S$, but usually the caustic cannot be regenerated. Various solid adsorptive processes may be used in which a solid having a high selectivity for $H_2S$ can be used to remove $H_2S$.

The process of the present invention gives refiners a way to use lift gas, without overloading their USGP. A side benefit of the invention is that by removing $H_2S$ from this lift gas stream, the ethene partial pressure is increased, allowing a higher ethene reaction rate in the riser. This will help promote alkylation of benzene.

We claim:

1. A process for the fluidized catalytic cracking of a feed containing sulfur and hydrocarbons boiling above 650 F. to catalytically cracked products comprising:

a) charging to a base portion of a riser reactor a stream of regenerated catalyst and an ethylene containing lift gas recovered from said catalytically cracked products and accelerating said catalyst up said riser reactor;

b) contacting said accelerated catalyst with said feed hydrocarbons in a lower portion of said riser reactor to produce a mixture of regenerated catalyst and feed;

c) cracking said mixture in said riser reactor to produce a mixture of cracked products including ethylene and $H_2S$ and spent catalyst which are discharged from a top portion of said riser reactor;

d) separating said mixture to produce a stream of catalytically cracked products which are removed as a product for transmission to an FCC main fractionator and a stream of spent catalyst containing entrained and absorbed catalytically cracked products and coke;

e) stripping said spent catalyst in a stripping means by contact with a stripping gas at stripping conditions to produce stripped catalyst;

f) regenerating said stripped catalyst in a catalyst regeneration means at catalyst regeneration conditions including contact with an oxygen containing gas to produce regenerated catalyst;

g) recycling said regenerated catalyst to said cracking reactor to contact said feed;

h) fractionating said cracked products in said FCC main fractionator to produce a plurality of liquid product streams and an overhead vapor stream containing ethylene and $H_2S$;

i) compressing said overhead vapor stream to produce a compressed vapor stream containing ethylene and $H_2S$;

j) splitting said compressed vapor stream into a lift gas fraction and a product fraction;

k) removing $H_2S$ from said lift gas fraction of said compressed vapor stream in an $H_2S$ removal means to produce a compressed vapor containing ethylene and a reduced $H_2S$ content relative to said product fraction;

l) recycling to said base of said riser reactor said lift gas fraction; and m) charging to a gas plant said product fraction of said compressed vapor.

2. The process of claim 1 wherein said overhead vapor fraction from said FCC main fractionator is compressed to an intermediate pressure, cooled, and passed through a vapor/liquid separator to produce an intermediate pressure vapor stream, and said intermediate pressure vapor is passed through an amine absorber to produce an intermediate pressure vapor product with a reduced $H_2S$ content, and said intermediate pressure vapor product is split into a lift gas stream which is recycled to the base of said riser reactor and a product stream which is charged to the gas plant.

3. The process of claim 1 wherein the intermediate pressure product stream is compressed in a compressor to produce a high pressure product stream which is charged to the gas plant.

4. The process of claim 1 wherein said overhead vapor fraction from said FCC main fractionator is compressed to an intermediate pressure, cooled, and passed through a vapor/liquid separator to produce an intermediate pressure vapor stream, and said intermediate pressure vapor is passed through an amine absorber to produce an intermediate pressure vapor product with a reduced $H_2S$ content, and said intermediate pressure vapor product is compressed in a secondary compressor to produce a high pressure vapor product with a reduced $H_2S$ content and then split into a lift gas stream which is recycled to the base of said riser reactor and a product stream which is charged to the gas plant.

5. The process of claim 1 wherein said intermediate pressure is 65 to 105 psig.

6. The process of claim 1 wherein 20 to 50 mole % of said intermediate pressure vapor product is recycled as lift gas.

7. The process of claim 2 wherein a rich amine stream, contaminated with $H_2S$, from the gas plant is used in the amine absorber operating at said intermediate pressure to produce said intermediate pressure vapor product with a reduced $H_2S$ content.

8. The process of claim 2 wherein said intermediate pressure vapor product with a reduced $H_2S$ content has less than 10% of the $H_2S$ content of the intermediate pressure vapor upstream of the amine absorber.

9. The process of claim 2 wherein said intermediate pressure vapor product with a reduced $H_2S$ content has 1 to 10% of the $H_2S$ content of the intermediate pressure vapor upstream of the amine absorber.

10. A process for the fluidized catalytic cracking of a feed containing sulfur and hydrocarbons boiling above 650 F. to catalytically cracked products comprising:

a) charging to a base portion of a riser reactor a stream of regenerated catalyst and an ethylene containing lift gas recovered from said catalytically cracked products and accelerating said catalyst up said riser reactor;

b) contacting said accelerated catalyst with said feed hydrocarbons in a lower portion of said riser reactor to produce a mixture of regenerated catalyst and feed;

c) cracking said mixture in said riser reactor to produce a mixture of cracked products including ethylene and $H_2S$ and spent catalyst which are discharged from a top portion of said riser reactor at a pressure of 1 to 75 psig;

d) separating said mixture to produce a stream of catalytically cracked products which are removed as a product for transmission to an FCC main fractionator and a stream of spent catalyst containing entrained and absorbed catalytically cracked products and coke;

e) stripping said spent catalyst in a stripping means by contact with a stripping gas at stripping conditions to produce stripped catalyst;

f) regenerating said stripped catalyst in a catalyst regeneration means at catalyst regeneration conditions including contact with an oxygen containing gas to produce regenerated catalyst;

g) recycling said regenerated catalyst to said cracking reactor to contact said feed;

i) fractionating said cracked products in said FCC main fractionator at a pressure of 0 to 60 psig to produce a plurality of liquid product streams and an overhead vapor stream containing ethylene and $H_2S$, said overhead vapor stream having a pressure of 0 to 60 psig;

j) compressing said overhead vapor stream at least 25 psi in a primary compressor to produce a primarily compressed vapor stream containing ethylene and $H_2S$ having a pressure above said FCC main fractionator;

k) removing $H_2S$ from said primarily compressed vapor in an amine absorber to produce a primarily compressed vapor containing ethylene and a reduced $H_2S$ content relative to said overhead vapor stream;

l) compressing said primarily compressed vapor in a secondary compressor to produce a high pressure vapor having a pressure of at least 150 psig and sufficient to charge to an unsaturated gas plant;

m) recycling to said base of said riser reactor a lift gas fraction obtained from said high pressure vapor stream; and n) charging to said gas plant high pressure vapor.

* * * * *